US006208070B1

(12) United States Patent
Sugimoto et al.

(10) Patent No.: US 6,208,070 B1
(45) Date of Patent: Mar. 27, 2001

(54) METAL VAPOR DISCHARGED LAMP WITH SPECIFIC ANGLE BETWEEN ELECTRODES AND TAPERED ENVELOPE WALL

(75) Inventors: Kouichi Sugimoto; Hiroshi Nohara, both of Osaka; Yoshiharu Nishiura, Shiga; Kazuo Takeda, Osaka; Shiki Nakayama, Osaka; Takashi Yamamoto, Osaka, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/218,480

(22) Filed: Dec. 22, 1998

(30) Foreign Application Priority Data

Dec. 26, 1997 (JP) ..... 9-360826

(51) Int. Cl.[7] ..... H01J 1/62
(52) U.S. Cl. ..... 313/493; 313/25; 313/634
(58) Field of Search ..... 313/25, 493, 634

(56) References Cited

U.S. PATENT DOCUMENTS 4,734,612 3/1988 Sasaki et al. .
4,749,905 6/1988 Mori et al. .
5,416,383 * 5/1995 Genz ..... 313/634
5,424,609 6/1995 Geven et al. .

FOREIGN PATENT DOCUMENTS 0 215 524 3/1987 (EP) .
0 587 238 3/1994 (EP) .
0 841 687 5/1998 (EP) .
62-283543 12/1987 (JP) .
9-283083 10/1997 (JP) .

* cited by examiner

*Primary Examiner*—Vip Patel
(74) *Attorney, Agent, or Firm*—Merchant & Gould P.C.

(57) ABSTRACT

A metal vapor discharge lamp comprises a discharge tube having a ceramic container into which a pair of electrodes and a discharge metal compound are sealed. The container comprises a first cylindrical portion, tapered portions, second cylindrical portions and third cylindrical portions. The third cylindrical portions are shrinkage-fitted to the second cylindrical portions. The electrodes are attached to the third cylindrical portion with a sealing member. An inner wall of the third cylindrical portions and the electrodes define a gap. The inner surface of the tapered portions and a central axis of the electrodes define an angle of 40°–80°. Thus, a metal vapor discharge lamp is provided whose discharge tube does not include disks among its parts, and which can maintain, over a long period of operation, good operating characteristics that depend only little on the lamp orientation.

18 Claims, 9 Drawing Sheets

METAL VAPOR DISCHARGED LAMP WITH SPECIFIC ANGLE BETWEEN ELECTRODES AND TAPERED ENVELOPE WALL

FIELD OF THE INVENTION

The present invention relates to a metal vapor discharge lamp using a ceramic material for the discharge tube.

BACKGROUND OF THE INVENTION

A conventional high-pressure metal vapor discharge lamp using a ceramic material for the discharge tube is disclosed, for example, in Publication of Unexamined Japanese Patent Application No. Hei 6-196131.

This conventional high-pressure metal vapor discharge lamp uses a discharge tube where the two ends of a cylindrical portion are plugged with disks by shrinkage fitting. Regardless of the lamp orientation of this high-pressure metal vapor discharge lamp during operation, in other words for vertical operation, where the metal vapor discharge lamp is arranged so that the axes direction of the electrodes point in a vertical direction, as well as for horizontal operation, where the metal vapor discharge lamp is arranged so that the axes of the electrodes point in a horizontal direction, a condensed phase of the excess discharge metal compound is present in the shrinkage-fitted plug portion. Thus, a high-pressure metal vapor discharge lamp whose operating characteristics are independent from the lamp orientation can be obtained.

However, since in this conventional high-pressure metal vapor discharge lamp the ends of two cylindrical portions of the discharge tube are plugged with disks by shrinkage fitting, the airtightness of the plug portion is not very reliable, and the lamp characteristics cannot be maintained sufficiently over long-term use.

Another configuration that has been proposed for high-pressure metal vapor discharge lamps using a ceramic discharge tube relates to a discharge tube with cylindrical portions and tapered portions, wherein the ends of two cylindrical portions are plugged by shrinkage fitting without disks. This high-pressure metal vapor discharge lamp can ensure airtightness with higher reliability, because the discharge tube is shrinkage-fitted without disks. However, its operating characteristics depend on the lamp orientation, and vary when the position of the condensed phase of the excess discharge metal compound changes.

It is an object of the present invention to solve the problems of the prior art. It is a further object of the present invention to provide a metal vapor discharge lamp wherein (a) the discharge tube does not include disks among its parts and (b) the shape of the discharge tube is optimized, so that good operating Characteristics are maintained over long-term use, and the operating characteristics depend only little on the lamp orientation.

SUMMARY OF THE INVENTION

In order to achieve this purpose, a metal vapor discharge lamp in accordance with the present invention comprises a discharge tube comprising a container made of ceramic. The ceramic container has a first cylindrical portion; second cylindrical portions with an outer diameter that is smaller than an inner diameter of the first cylindrical portion; third cylindrical portions with and outer diameter that is substantially the same as an inner diameter of the second cylindrical portion; and tapered portions having an inner surface. The ceramic container contains a discharge metal compound sealed into the ceramic container. The metal vapor discharge lamp further comprises a pair of electrodes having first ends and second ends arranged in the ceramic container. The first cylindrical portion, the tapered portions and the second cylindrical portions are formed in one piece. Each of the third cylindrical portions is attached to one of the second cylindrical portions. The first ends of the pair of electrodes oppose each other inside the ceramic container. The second ends of the pair of electrodes are attached and sealed into the third cylindrical portions using a sealing member. An inner wall of the third cylindrical portions and the electrodes define a gap. The inner surface of the tapered portions and a central axis of the electrodes define an angle of 40°–80°.

This configuration raises the reliability with regard to airtightness compared to conventional configurations, which used disks for the sealing by shrinkage-fitting, because the first cylindrical portion, the second cylindrical portions and the tapered portions are formed in one piece. Moreover, a lamp whose characteristics do not depend on its orientation can be attained, because the inner surface of the tapered portions and a central axis of the electrodes define angle of 40°–80°.

It is preferable that the metal vapor discharge lamp satisfies $$0.85\ d \leqq D \leqq 0.95\ d.$$

wherein d (mm) in an inner diameter of the third cylindrical portions and D (mm) is an outer diameter of at least a portion of the electrodes.

This configuration makes it possible to obtain a metal vapor discharge lamp with a long lifetime whose operating characteristics depend only little on the lamp orientation, because the condensed phase of the discharge metal compound does not easily enter the space between the electrodes and the third cylindrical portions during lamp operation.

It is preferable that an axial length L (mm) of the gap defined by the inner wall of the third cylindrical portions and the electrodes of the metal vapor discharge lamp is 3 mm$\leqq$L$\leqq$10 mm.

If the axial length of the gap is less than 3 mm, the end face of the sealing member in the third cylindrical portion is close to the discharge space, so that the lamps lifetime is shortened due to the reaction between the sealing member and the discharge metal compound. On the other hand, if the axial length of the gap is more than 10 mm, the amount of the condensed phase of the discharge metal compound that enters the gap between the electrodes and the third cylindrical portions during operation becomes too large, so that the desired initial lamp characteristics cannot be attained. Consequently, in the present invention, it is preferable that that the axial length of the gap is within the above-mentioned range.

Moreover, it is preferable that the sealing member of the metal vapor discharge lamp comprises a cermet. This preferable configuration makes it possible to obtain a metal vapor discharge lamp that is very resistant against thermal shocks that occur, for example, when the discharge tube is sealed or when the lamp is turned on or off. This is because the cermet plugs have an expansion coefficient that is closer to the expansion coefficient of the ceramic of the discharge tube than the feed portions.

DESCRIPTION OF THE PREFERRED EMBODIMENTS

The following is an explanation of preferred embodiments of the present invention with reference to the accompanying drawings.

First Embodiment

Figure 1:
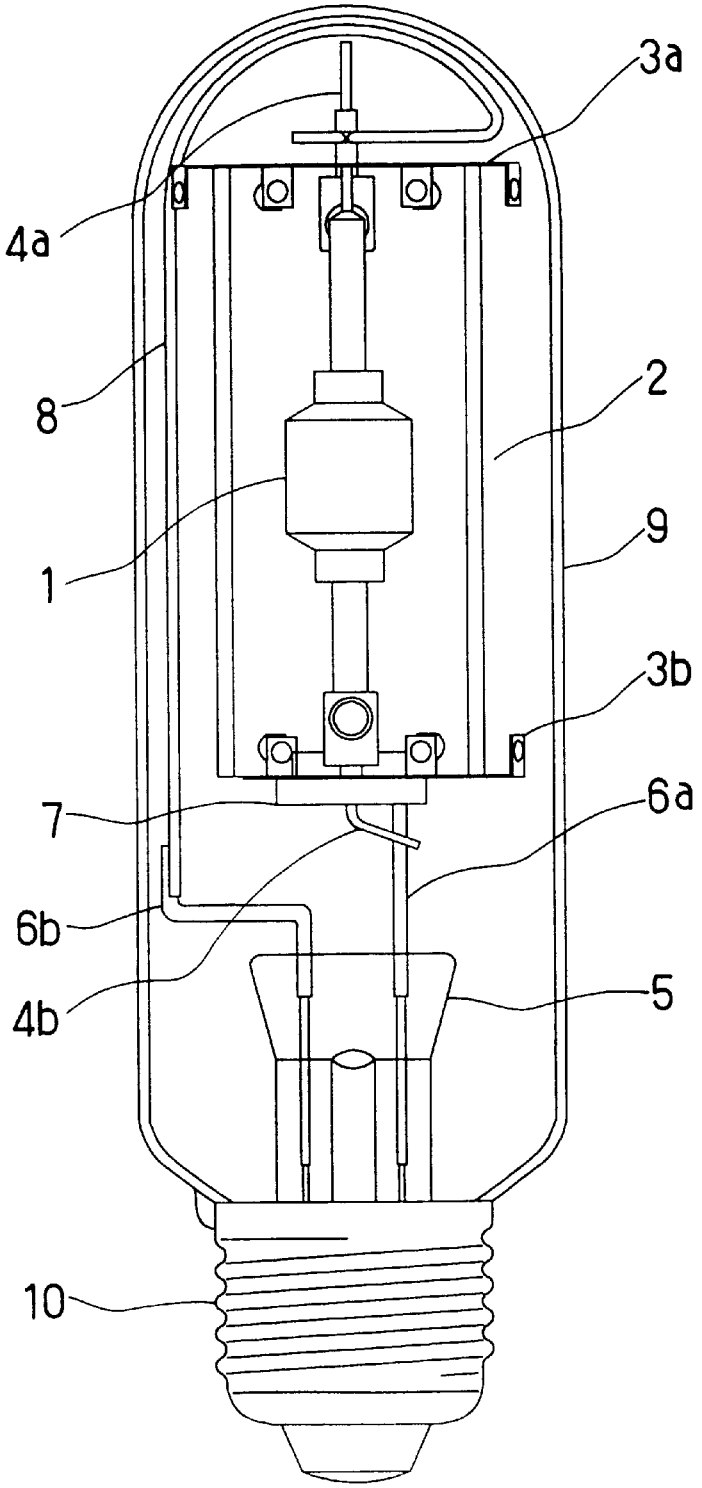
FIG. 1 is a cross-sectional view outlining the configuration of a high-pressure metal vapor discharge lamp according to a first embodiment of the present invention.

FIG. 1 is a cross-sectional view outlining the configuration of a high-pressure metal vapor discharge lamp according to the first embodiment of the present invention. As shown in FIG. 1, the high-pressure metal vapor discharge lamp according to this embodiment comprises a ceramic discharge tube 1 inside an outer tube 9, a transparent cylinder 2 surrounding the discharge tube 1, and metal plates 3*a* and 3*b* supporting the transparent cylinder 2. A current supply wire 4*a* is lead through a first side of the discharge tube 1, and a current supply wire 4*b* is lead through a second side of the discharge tube 1. Inside the outer tube 9, the high-pressure metal vapor discharge lamp further comprises a stem 5, a supporting wire 6*a*, which passes through the metal plate 3*b* and is supported by the stem 5, a supporting wire 6*b* that is similarly supported by the stem 5, a supporting wire 8 connected to the supporting wire 6*b*, and an insulating sleeve 7 provided at the metal plate 3*b*. A base 10 is attached to an aperture portion of the outer tube 9.

The current supply wire 4*b* is connected to the supporting wire 6*a*. The current supply wire 4*a* is welded to the metal plate 3*a* and to the supporting wire 8, which is connected to the supporting wire 6*b*.

The current supply wire 4*b* and the metal plate 3*b* of this embodiment are insulated by the insulating sleeve 7. The stem 5 seals the discharge tube 1 into the outer tube 9, and the base 10 is attached so as to cover the sealing portion of the stem 5 while evacuating the outer tube 9.

Figure 2:
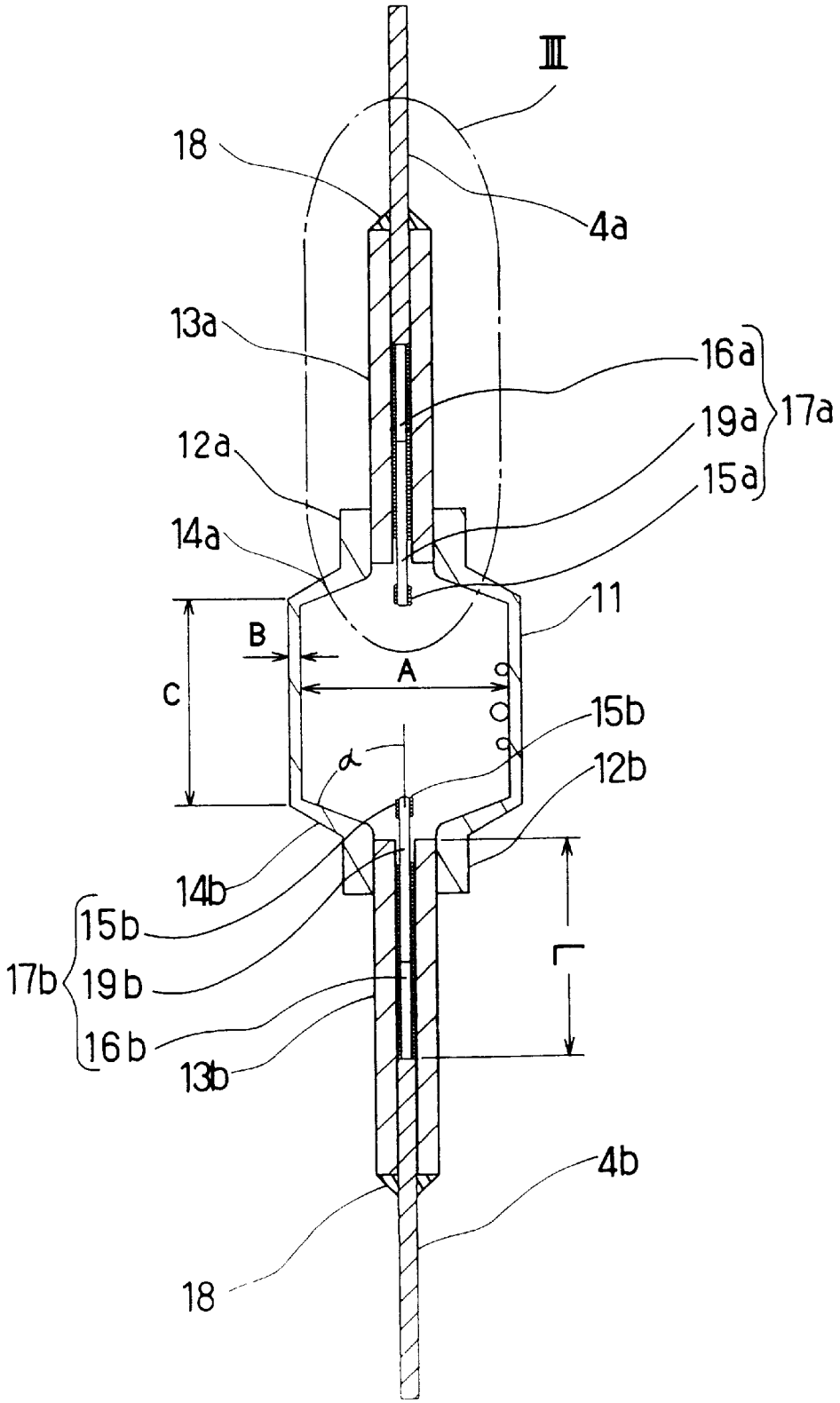
FIG. 2 is an enlarged cross-sectional view of the discharge tube of the high-pressure metal vapor discharge lamp in FIG. 1.
Figure 3:
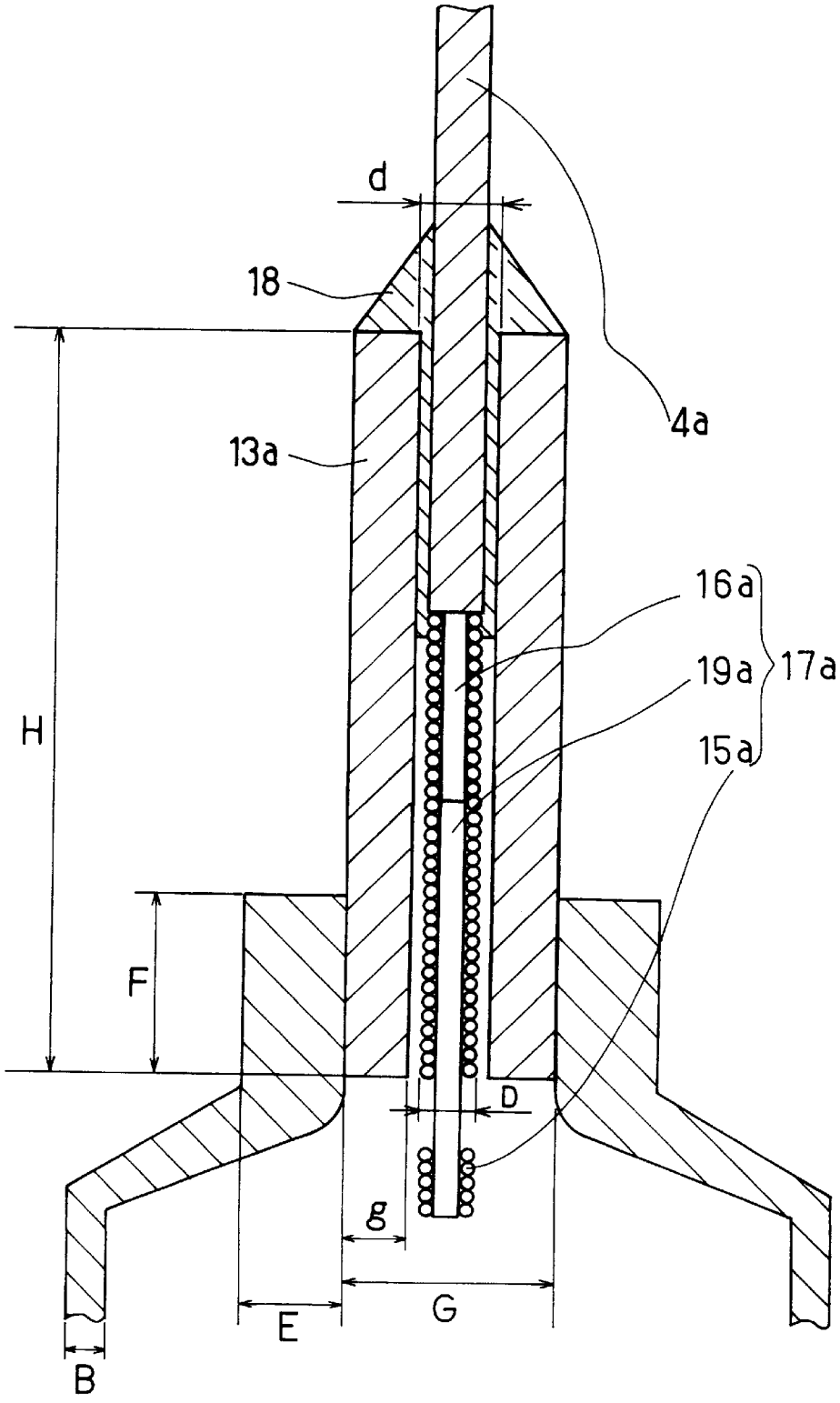
FIG. 3 is an enlarged cross-sectional view of part III of the discharge tube in FIG. 2.

FIG. 2 is an enlarged view of the discharge tube 1 in the high-pressure metal vapor discharge lamp of FIG. 1. FIG. 3 is an enlarged view of part III of the discharge tube 1 in FIG. 2. As shown in FIGS. 2 and 3, the discharge tube of the present embodiment comprises a first cylindrical portion 11, second cylindrical portions 12*a* and 12*b*, third cylindrical portions 13*a* and 13*b*, and tapered portions 14*a* and 14*b* connecting the first cylindrical portion 11 to the second cylindrical portions 12*a* and 12*b*. The first cylindrical portion 11, the tapered portions 14*a* and 14*b*, and the second cylindrical portions 12*a* and 12*b* are formed in one piece. The angle between the tapered portion 14*a* and the central axis of an electrode 17*a* is $\alpha$. Also the angle between the tapered portion 14*b* and the central axis of an electrode 17*b* is $\alpha$.

The second cylindrical portion 12*a* and the third cylindrical portion 13*a*, as well as the second cylindrical portion 12*b* and the third cylindrical portion 13*b* are connected by shrinkage fitting. The inner diameter of the third cylindrical portions 13*a* and 13*b* is d (in mm).

The electrodes 17*a* and 17*b* of the present embodiment comprise feed portions 16*a* and 16*b*, and electrode rods 19*a* and 19*b*, which are fixed with electrode coils 15*a* and 15*b* to one side of the feed portions. The electrode coils 15*a* and 15*b* connect the ends of the feed portions 16*a* and 16*b* to the ends of the electrode rods 19*a* and 19*b* and hold them together. The other ends of the feed portions 16*a* and 16*b* are connected to the current supply wires 4*a* and 4*b*. A frit seal 18 is filled into the third cylindrical portions 13*a* and 13*b* at a portion of the current supply wires 4*a* and 4*b* and a portion of the feed portions 16*a* and 16*b*, so that the inside of the first cylindrical portion 11, the second cylindrical portions 12*a* and 12*b* and the third cylindrical portions 13*a* and 13*b* is airtightly sealed. A coil is wound around the feed portions 16*a* and 16*b*, and including the coil, the outer diameter of the feed portions 16*a* and 16 b is D (in mm). The length of the portion where a small gap is formed between the third cylindrical portions 13*a* and 13*b* and the electrodes 17*a* and 17*b* is L (in mm).

The axial length C of the first cylindrical portion 11 is 10.8 mm, its inner diameter A is 10.7 mm, its wall-thickness B is 0.65 mm. It is preferable that A/C is at least 0.8. The wall-thickness E of the second cylindrical portions 12*a* and 12*b* is 1.6 mm. The axial length H of the third cylindrical portion is 17.3 mm. The axial length of the overlapping portion F of the second cylindrical portions 12*a* and 12*b* with the third cylindrical portions 13*a* and 13*b* is 3.1 mm, and the outer diameter G of the third cylindrical portions 13*a* and 13*b* (i.e. the inner diameter of the second cylindrical portions 12*a* and 12*b*) is 3.2 mm.

For a discharge tube 1 as described above, we investigated how the initial characteristics depend on variations of the lamp orientation when the angle $\alpha$ is varied between 30 and 80°. The differences in the correlated color temperature at 150 W lamp power between vertical operation and horizontal operation were taken as the initial characteristics dependent on variations of the lamp orientation.

A tungsten wire of 0.25 mm sectional diameter wound five turns around the electrode rods 19*a* and 19*b* was used for the electrode coils 15*a* and 15*b*. A tungsten rod with 0.5 mm sectional diameter was used for the feed portions 16*a* and 16*b*. The inner diameter of the third cylindrical portion was 1 mm, and a molybdenum wire of 0.2 mm sectional diameter wound 50 turns around the feed portions 16*a* and

16*b* was used for the coils. A niobium wire of 0.92 mm sectional diameter was used for the current feed wires 4*a* and 4*b*. Tungsten rods were used for the electrode rods 19*a* and 19*b*. For the sealed in metal compound, 5.0 mg of dysprosium iodide, thallium iodide, sodium iodide and lithium iodide in a weight ratio of 22:19:55:4 was added to 16 KPa argon gas. Then a suitable amount of mercury was added to establish a lamp voltage of 93V.

The molybdenum wire coil that is wrapped around the feed portion 16*a* and the electrode rod 19*a* provides a high temperature resistance and a low reactivity with the emission metallic compound (halide). It is also possible to use a tungsten wire instead of the molybdenum wire.

Figure 4:
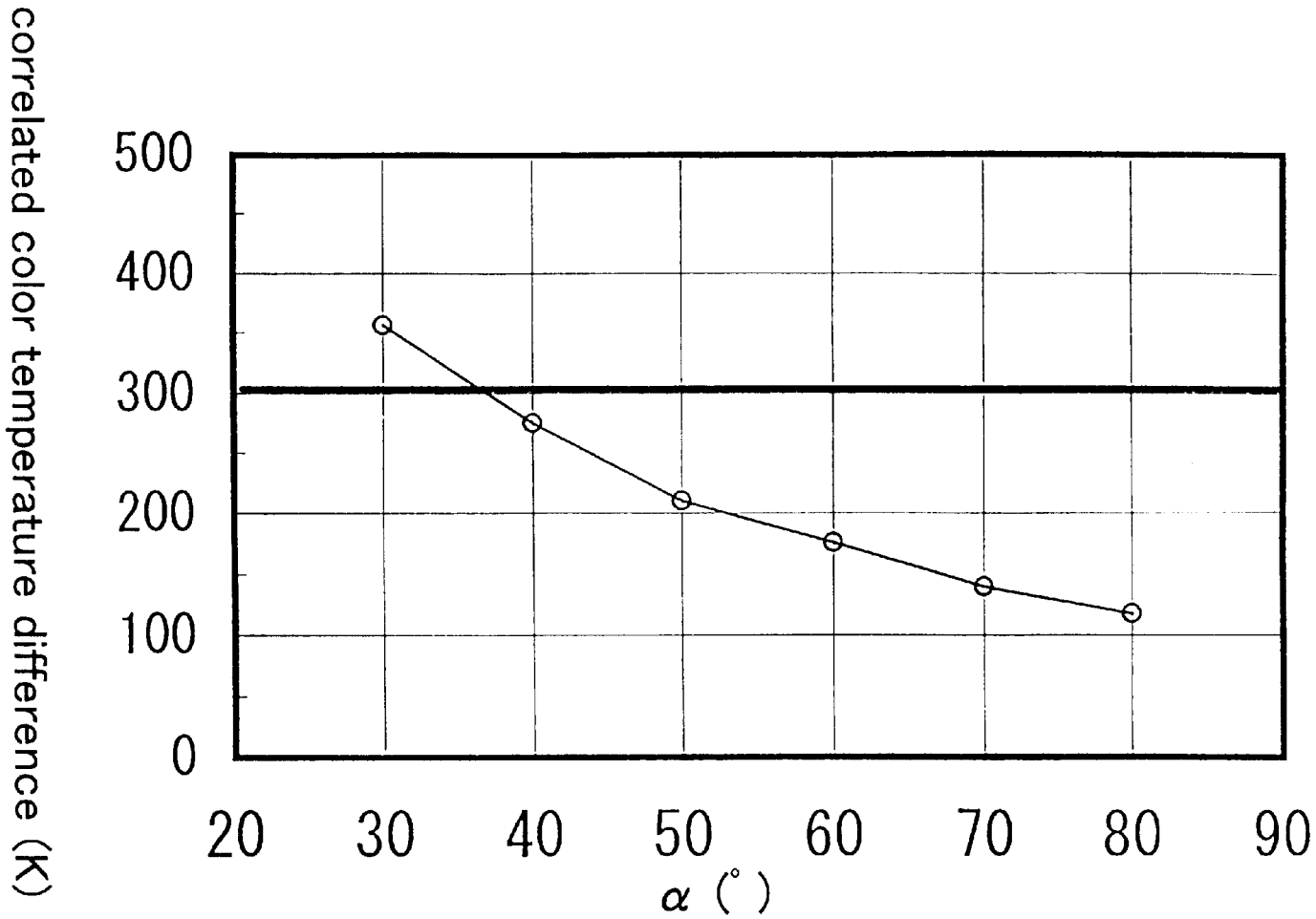
FIG. 4 is a graph showing how the correlated color temperature difference due to the lamp orientation depends on the angle a of the tapered portion of the high-pressure metal vapor discharge lamp according to the first embodiment of the present invention

The result of the above investigation is shown in FIG. 4, where the abscissa marks the angle $\alpha$, and the ordinate marks the difference between the correlated color temperatures. As becomes clear from FIG. 4, the operating characteristics do not depend as strongly on the lamp orientation when the angle a is large, and to keep the change of the correlated color temperatures below 300 K, $\alpha$ has to be at least 40°. When the discharge tube is produced, the discharge tube material is expanded along a form or poured into a form. Thus, for angles $\alpha$ of more than 80°, it is difficult to sustain the thickness of the tapered portions 14*a* and 14*b*, and irregularities become considerable, so that the production of such a discharge tube becomes difficult. Therefore, angles a of more than 80°, have been exempted from our investigation.

Next, the angle $\alpha$ was set to 45°, and the inner diameter d of the third cylindrical portion 13*a* and 13*b* to 1 mm. Then, the diameter of the molybdenum wire wrapped around the feed portions 16*a* and 16*b* was changed so that the outer diameter D of the feed portions 16*a* and 16*b* varied between 0.7 mm and 0.95 mm, and the dependency of the initial characteristics on the lamp orientation variations was examined. As above, we took the difference between the correlated color temperatures as the initial characteristics.

Figure 5:
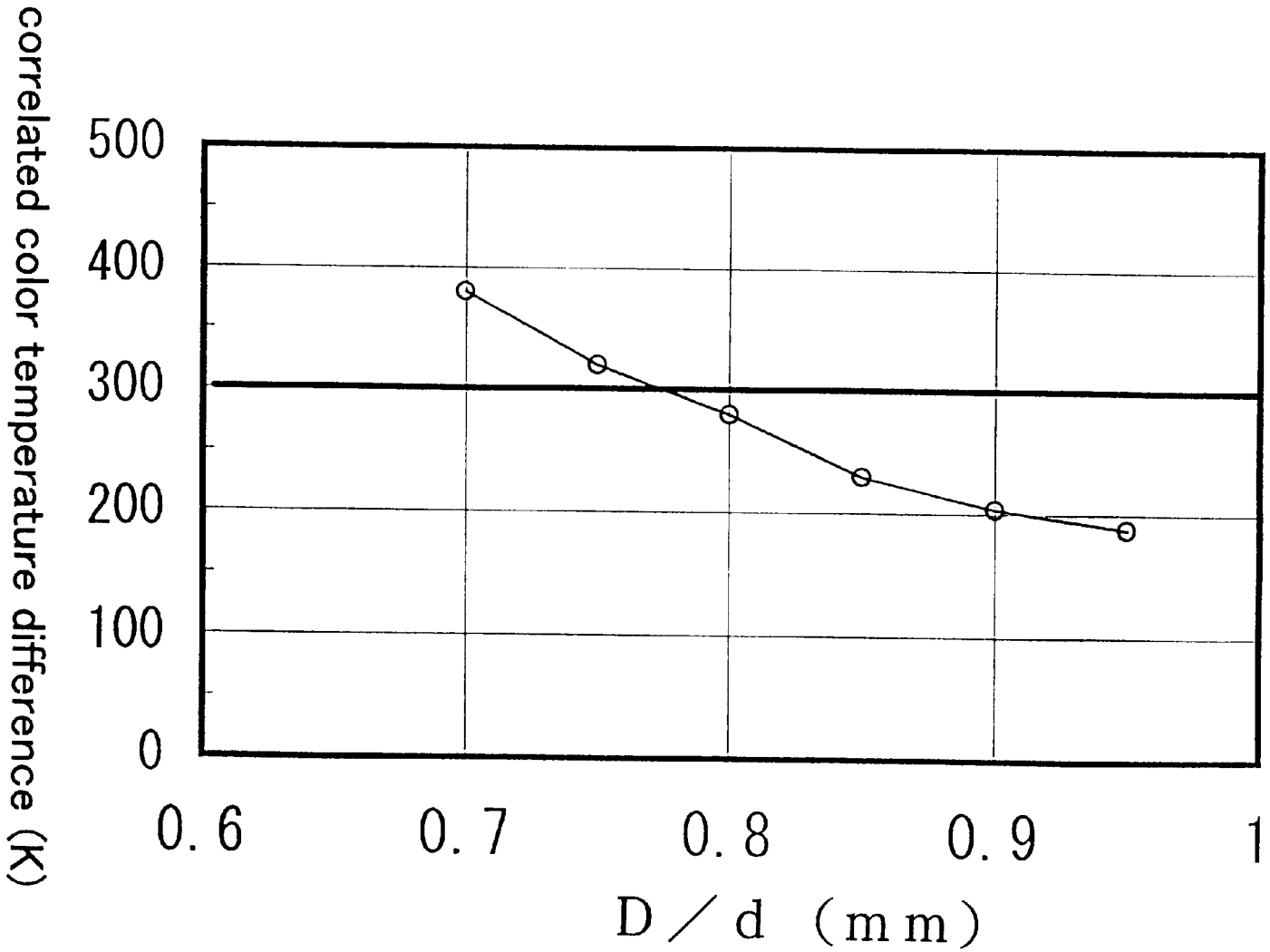
FIG. 5 is a graph showing how the correlated color temperature difference due to the lamp orientation depends on the outer diameter D of the need portions of the high-pressure metal vapor discharge lamp according to the first embodiment of the present invention.

The result of the above investigation is shown in FIG. 5, where the abscissa marks the ratio between the outer diameter D (in mm) of the feed portion and the inner diameter d (in mm) of the third cylindrical portion, and the ordinate marks the difference between the correlated color temperatures. As becomes clear from FIG. 5, the operating characteristics do not depend as strongly on the lamp orientation when the outer diameter D is large, and to keep the change of the correlated color temperatures below 300 K, the outer diameter D has to be at least 0.8 mm. Because of dimensional irregularities in the feed portions 16*a* and 16*b* and the third cylindrical portions 13*a* and 13*b*, the coils wound around the feed portions 16*a* and 16*b* occasionally cannot be inserted into the third cylindrical portions 13*a* and 13*b* when the outer diameter D is larger than 0.95 mm, and a production with a good yield cannot be attained, so that larger outer diameters D have been exempted from our investigation. Thus, the result of our investigation is that it is preferable that the relationship between the inner diameter d of the third cylindrical portions 13*a* and 13*b* and the outer diameter D of the feed portions 16*a* and 16*b* is governed by $$0.85\ d \leqq D \leqq 0.95\ d.$$

In the present embodiment, the outer diameter D of the feed portions 16*a* and 16*b* was 0.9 mm and the inner diameter d of the third cylindrical portions 13*a* and 13*b* was set to 1 mm.

Next, the angle $\alpha$ was set to 45°, and the inner diameter d of the third cylindrical portions 13*a* and 13*b* to 1 mm. Then, it was investigated how the luminous flux maintenance factor and the initial correlated color temperature at vertical operation depend on the gap length L, which was varied between 1 mm and 12 mm.

Figure 6:
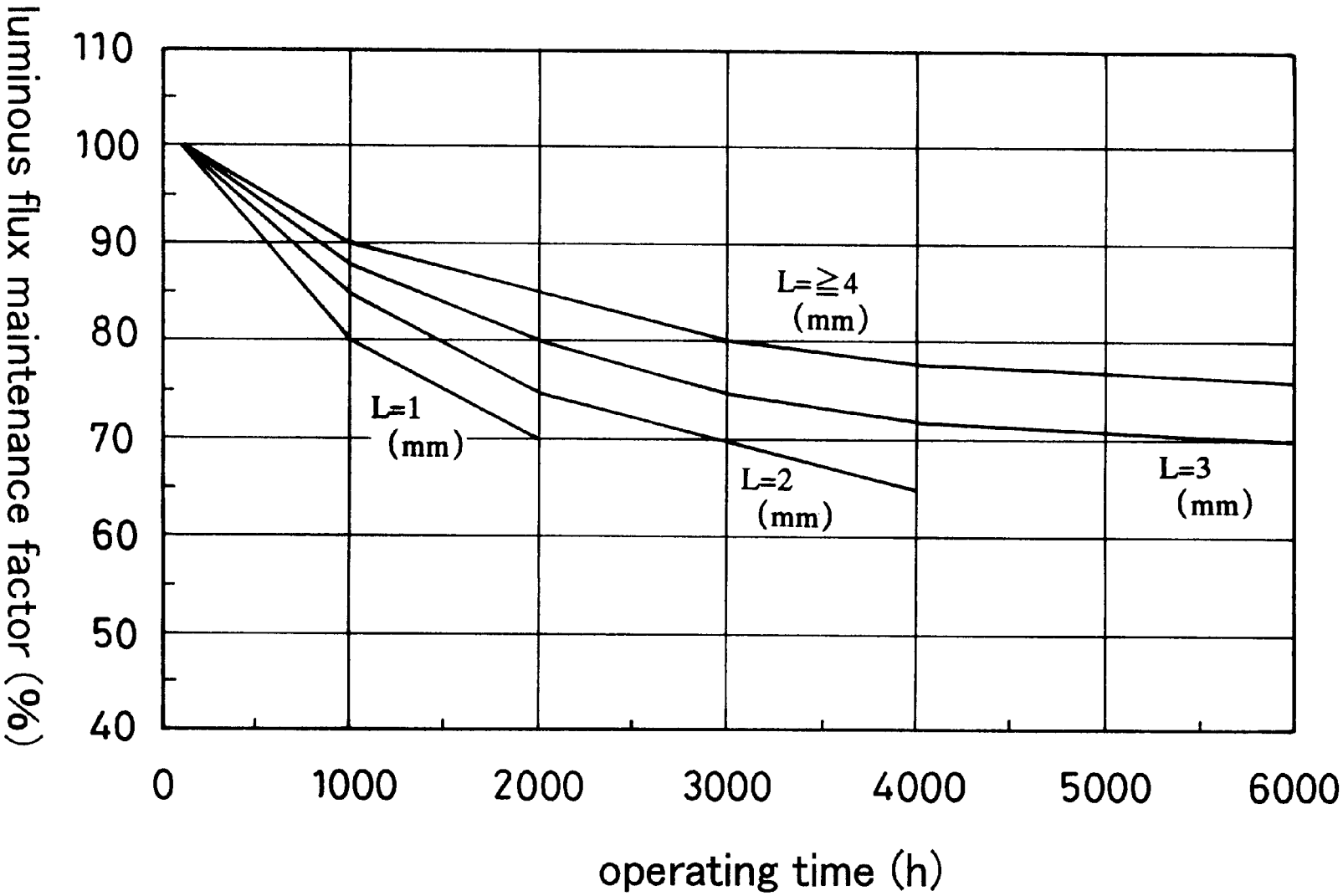
FIG. 6 is a graph showing how the luminous flux maintenance factor depends on the operating time of the high-pressure metal vapor discharge lamp according to the first embodiment of the present invention.
Figure 7:
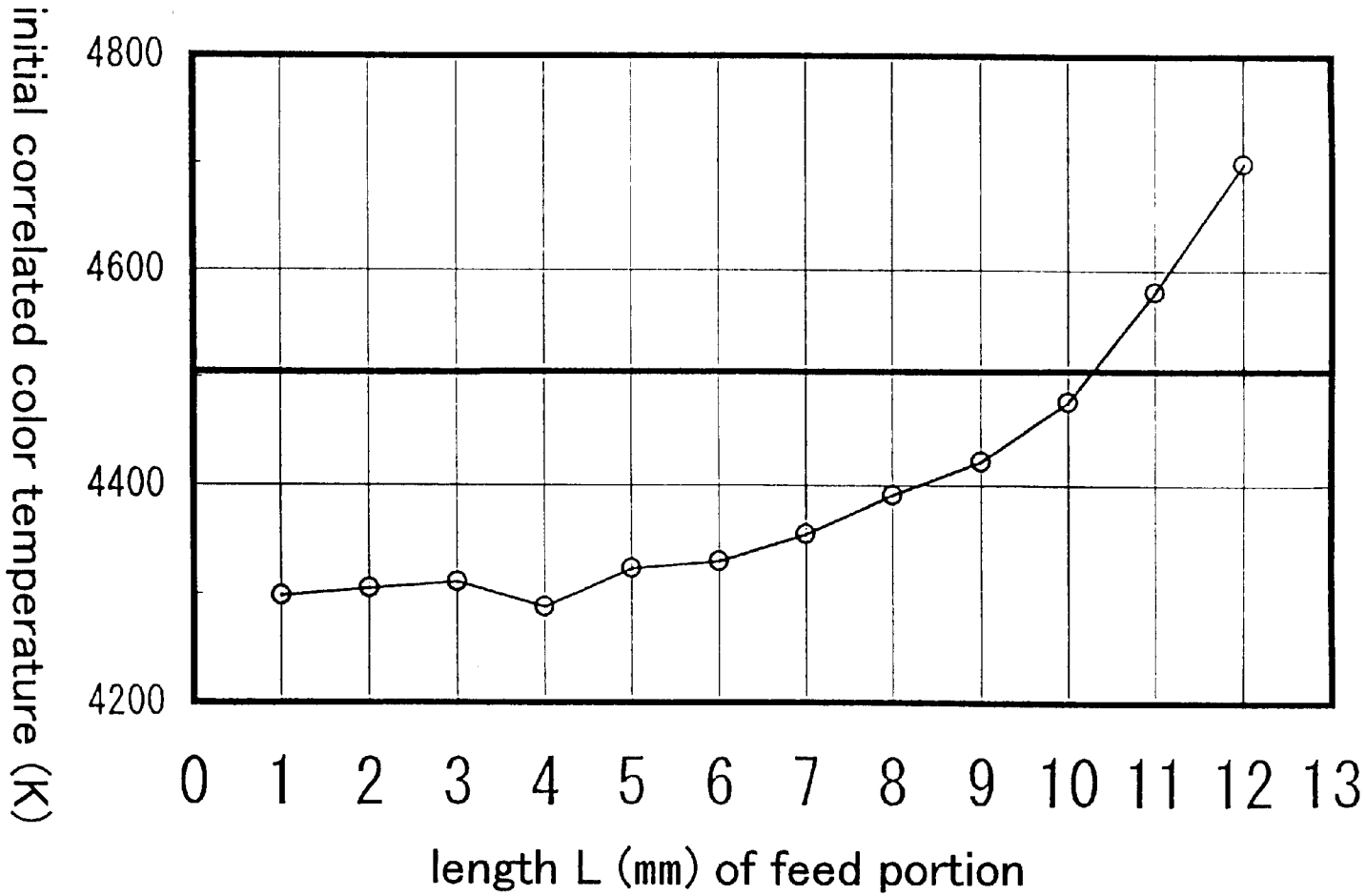
FIG. 7 is a graph showing how the initial correlated color temperature depends on the length L of the gap between the feed portion and the third cylindrical portion of the high-pressure metal vapor discharge lamp according to the first embodiment of the present invention.

The result of these investigations is shown in FIGS. 6 and 7. As is shown in FIG. 6, when L is less than 3 mm (i.e. when L=1 mm or L=2 mm), a lifetime of 6000 hours cannot be achieved, and the luminous flux maintenance factor drops below 70% at an early stage. On the other hand, when L is at least 3 mm, a luminous flux maintenance factor of more than 70% can be maintained even after an operating time of 6000 hours. However, when L is 11 mm or larger, the initial correlated color temperature digresses from the target range of 4100 K–4500 K, as can be seen from FIG. 7. In order to correct this, the sealed material can be increased, or the tubewall load can be raised, but these methods decrease the lifetime of the lamp. Thus, in the present embodiment, it is preferable that the length L of the gap in the feed portions 16*a* and 16*b* is $$3\ \text{mm} \leqq L \leqq 10\ \text{mm}.$$

Thus, according to the present embodiment, a metal vapor discharge lamp can be obtained that displays excellent color rendition with high luminous efficacy, and has excellent long-term use characteristics (lifetime) regardless of the lamp orientation.

It is preferable that the axial length of the overlapping portion F (see FIG. 3) of the second cylindrical portion 12*a* with the third cylindrical portion 13*a* is $$1.5\ \text{mm} \leqq F \leqq 4.5\ \text{mm}.$$

If F is less than 1.5 mm, gaps appear easily in the junction between the second cylindrical portion 12*a* and the third cylindrical portion 13*a*, and problems with the airtightness may develop. On the other hand, if F is larger than 4.5 mm, the thermal capacity of the second cylindrical portion 12*a* becomes too large, the heat loss increases, and the luminous efficacy of the lamp decreases.

It is preferable that the relation between the wall thickness E of the second cylindrical portion 12*a* and the wall thickness g of the third cylindrical portion 13*a* is $$0.5\ g \leqq E \leqq 3\ g.$$

If E is less than 0.5 g, the strength of the junction of the second cylindrical portion 12*a* and the third cylindrical portion 13*a* may not be sufficient. On the other hand, if E is larger than 3 g, the thermal capacity of the second cylindrical portion 12*a* becomes too large, the heat loss increases, and the luminous efficacy of the lamp decreases.

It is preferable that the relation between the wall thickness B of the first cylindrical portion 11 and the wall thickness E of the second cylindrical portion 12*a* is $$0.8 \leqq E/B \leqq 4.0.$$

If E/ B is less than 0.8, the strength of the junction of the second cylindrical portion 12*a* and the third cylindrical portion 13*a* may not be sufficient. On the other hand, if E/B is larger than 4.0, the thermal capacity of the second cylindrical portion 12*a* becomes too large, the heat loss increases, and the luminous efficacy of the lamp decreases.

It is preferable that the relation between the axial length F of the second cylindrical portion 12*a* and the axial length H of the third cylindrical portion 13*a* is $$0.1 \leqq F/H \leqq 0.3.$$

If F/H is less than 0.1, gaps appear easily in the junction between the second cylindrical portion 12*a* and the third cylindrical portion 13*a,* and problems with the airtightness may develop. On the other hand, if F/H is larger than 0.3, the thermal capacity of the second cylindrical portion 12*a* becomes too large, the heat loss increases, and the luminous efficacy of the lamp decreases.

Second Embodiment

Figure 8:
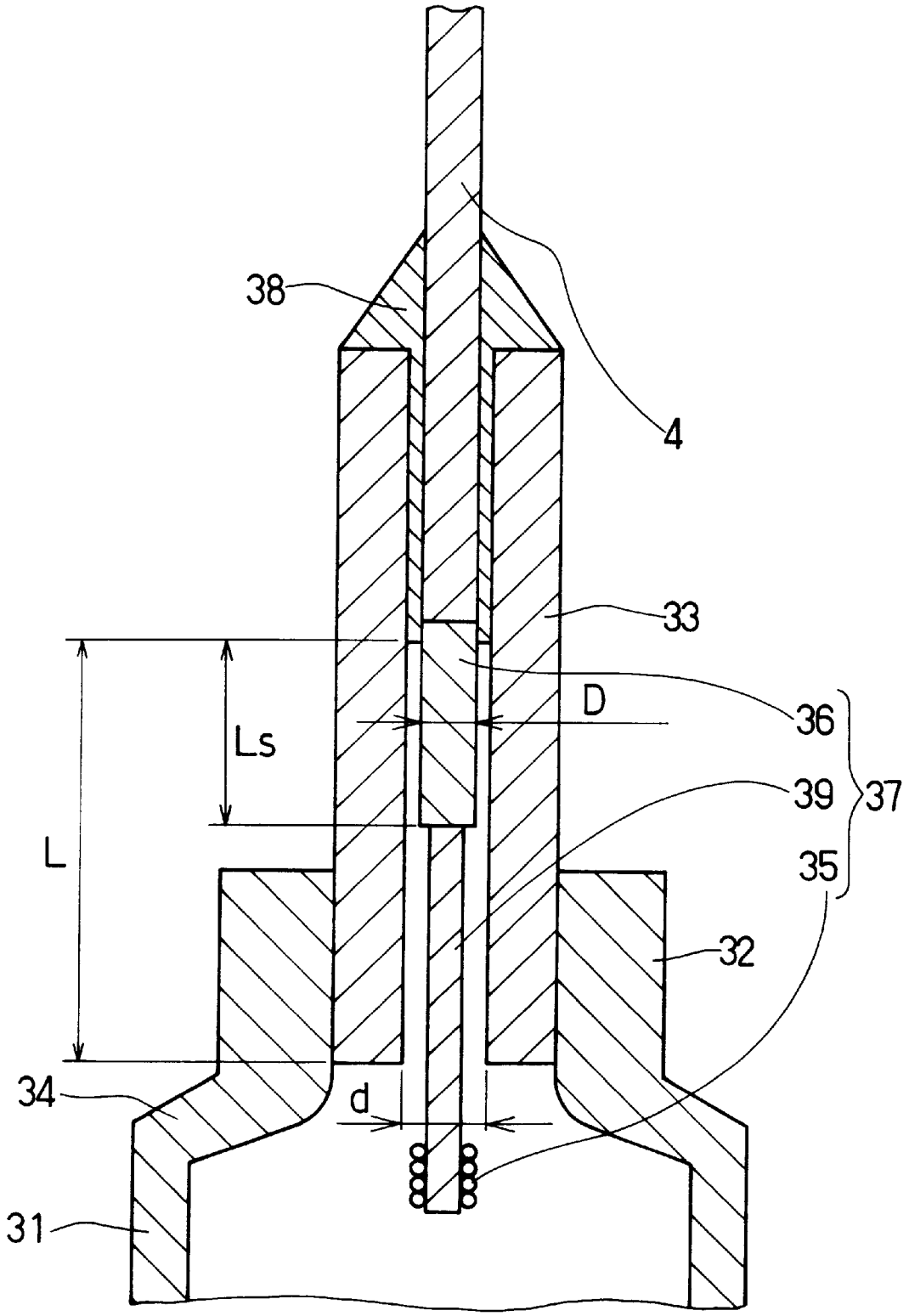
FIG. 8 is an enlarged partial cross-sectional view of the discharge tube of a high-pressure metal vapor discharge lamp according to a second embodiment of the present invention.

FIG. 8 shows an enlarged partial cross-sectional view of a discharge tube in a high-pressure metal vapor discharge lamp according to a second embodiment of the present invention. The discharge tube of this embodiment has basically the same configuration as the discharge tube in the first embodiment, only the configuration of the feed portion is different. In the first embodiment, a coil is wound around the feed portions, and the spacing between the outer diameter D of the feed portion in conjunction with the coil and the inner diameter d of the third cylindrical portion was prescribed. In this embodiment, on the other hand, no coil is wound around the feed portion 36, and the spacing between the outer diameter D of the feed portion 36 itself and the inner diameter d of the third cylindrical portion 33 is prescribed.

The discharge tube of this embodiment includes a first cylindrical portion 31, tapered portions 34, and second cylindrical portions 32 that are formed in one piece. The second cylindrical portions 32 and the third cylindrical portions 33 are plugged together by shrinkage fitting. Moreover, in this embodiment, the electrode 37 comprises an electrode rod 39 to which an electrode coil 35 is attached on one end, and a feed portion 36 connected to the other end of the electrode rod 39. Furthermore, a current supply wire 4 is connected to the other end of the feed portion 36 (i.e. the end that is not connected to the electrode rod 39). A portion of the current supply wire 4 and a portion of the feed portion 36 are airtightly sealed with the third cylindrical portion 33 and a frit seal 18.

The discharge tube of the high-pressure metal vapor discharge lamp according to this embodiment thus differs from the discharge tube in the first embodiment in the configuration of the electrode shaft (there is no coil wound around the feed portions in this embodiment). However, the configuration of all other elements is basically the same, and, as has been mentioned above, the relationship between the outer diameter D of the feed portion 36 and the inner diameter d of the third cylindrical portion 33 is governed by $$0.8\ d \leqq D \leqq 0.95\ d.$$

Moreover, as mentioned above, the length L of the gap between the feed portion 36 and the third cylindrical portion 33 is $$3\ \text{mm} \leqq L \leqq 10\ \text{mm}.$$

Consequently, the present embodiment can attain the same positive effects as the first embodiment. To be specific, the outer diameter D of the feed portion 36 can be set to 0.92 mm, and the inner diameter d of the third cylindrical portion 33 to 1.0 mm, the length L of the gap to 7 mm, and the outer diameter of the electrode including the electrode coil 35 wound around it can be 0.5 mm.

Moreover, since the feed portion 36 in this embodiment is configured as described above, the condensed phase of the sealed-in material does not as easily enter the space between the inner wall of the third cylindrical portion 33 and the electrode 37 (feed portion 36), so that a high-pressure metal vapor discharge lamp with a long lifetime whose operating characteristics depend only little on the lamp orientation can be obtained.

It is preferable that the relation between the axial length $L_S$ of the gap formed between the inner wall of the third cylindrical portion 33 and the feed portion 36 and the axial length L of the gap between the inner wall of the third cylindrical portion 33 and the electrode 37 is $$0.4\ L \leqq L_S \leqq 1.0\ L.$$

If $L_S$ is less than 0.4 L, too much condensed phase of the excess discharge metal enters the gap between the inside of the third cylindrical portion 33 and the electrode coil 35, and the dependency of the lamp characteristics on the lamp's orientation becomes strong. If, on the other hand, $L_S$ is greater than 1.0 L, the feed portion protrudes into the discharge space, so that calescent points due to arc discharge develop on the feed portion, which may result in negative effects, such as the blackening of the discharge tube.

Third Embodiment

Figure 9:
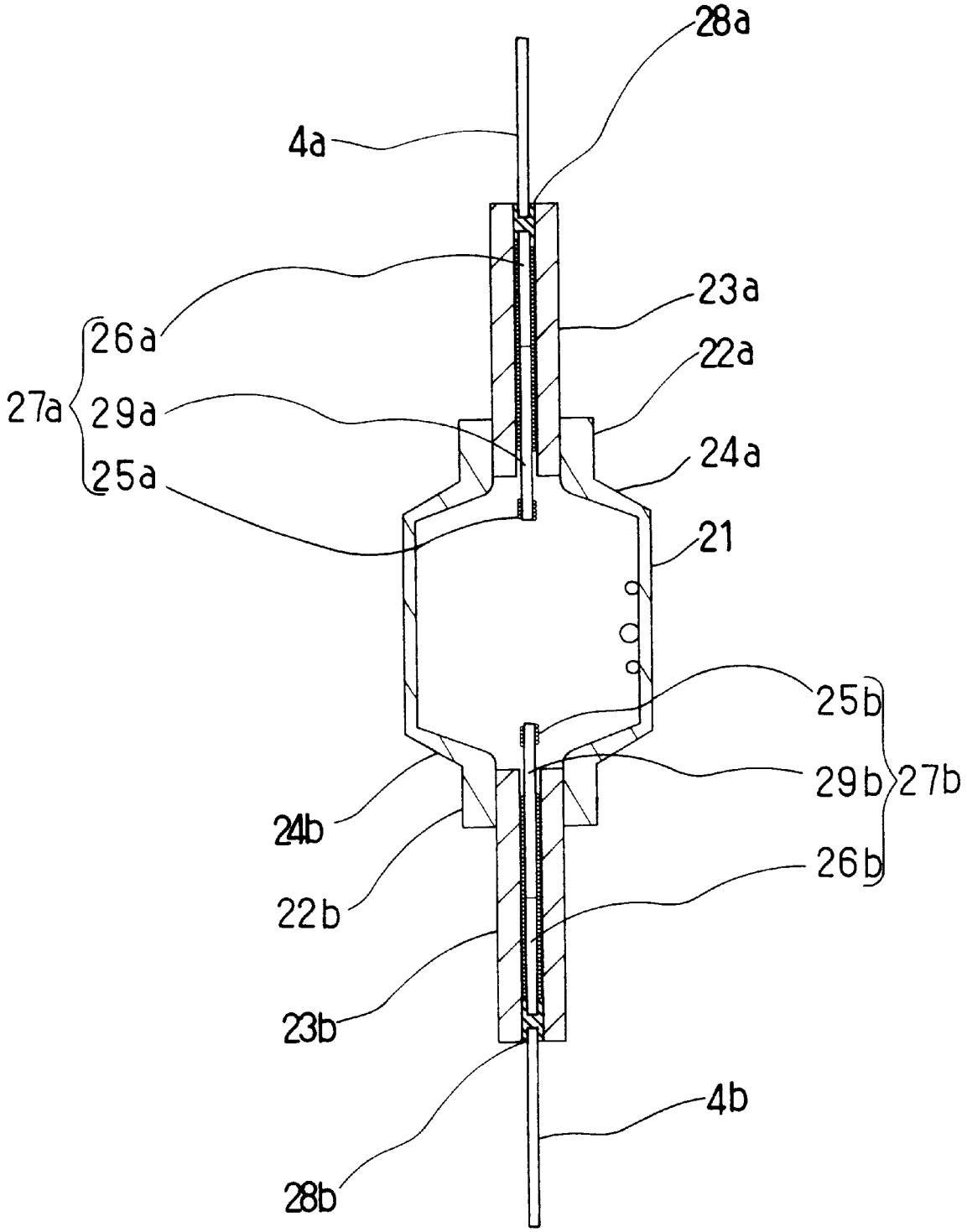
FIG. 9 is an enlarged partial cross-sectional view of the discharge tube of a high-pressure metal vapor discharge lamp according to a third embodiment of the present invention.

FIG. 9 shows an enlarged cross-sectional view of a discharge tube in a high-pressure metal vapor discharge lamp according to a third embodiment of the present invention. The discharge tube of this embodiment has basically the same configuration as the discharge tube in the first embodiment, only the configuration of the electrodes 27*a* and 27*b,* and the method with which the electrodes 27*a* and 27*b* are sealed into the third cylindrical portions 23*a* and 23*b* is different.

The electrodes 27*a* and 27*b* comprise electrode rods 29*a* and 29*b,* electrode coils 25*a* and 25*b* fixed to first ends of the electrode rods 29*a* and 29*b* and feed portions 26*a* and 26*b* connected to second ends of the electrode rods 29*a* and 29*b*. The second ends of the feed portions 26*a* and 26*b* are connected to first ends of cermet plugs 28*a* and 28*b*. The second ends of the cermet plugs 28*a* and 28*b* are connected to first ends of current supply wires 4*a* and 4*b*. The cermet plugs 28*a* and 28*b* seal the electrodes 27*a* and 27*b* into the third cylindrical portions 23*a* and 23*b*. The cermet plugs 28*a* and 28*b* are made of aluminium oxide and molybdenum. Molybdenum also was used as a material for the current supply wires 4*a* and 4*b*.

The discharge tube according to the present embodiment is formed in one piece comprising a first cylindrical portion 21, tapered portions 24*a* and 24*b* and second cylindrical portions 22*a* and 22*b*. The second cylindrical portions 22*a* and 22*b* and the third cylindrical portions 23*a* and 23*b* are plugged together by shrinkage fitting.

The discharge tube in the high-pressure metal vapor discharge lamp according to this embodiment thus differs from the discharge tube in the first embodiment in the method of sealing (structure) the electrode into the third cylindrical portion. However, the configuration of all other elements is basically the same, so that the present embodiment can attain the same positive effects as the first embodiment by adjusting the dimensions of various structural elements to appropriate ranges.

Moreover, since the present embodiment uses cermet plugs 28*a* and 28*b* for the sealing of the electrodes 27*a* and 27*b* into the third cylindrical portions 23*a* and 23*b*, a high-pressure metal vapor discharge lamp can be obtained that is very resistant against thermal shocks that occur, for example, when the discharge tube is sealed or when the lamp is turned on or off, and has sealing portions that do not crack readily. This is because the cermet plugs have an expansion coefficient that is closer to the expansion coefficient of the ceramic of the discharge tube 1 than the feed portions (electrodes).

Moreover, by sealing the cermet plugs 28*a* and 28*b* completely into the third cylindrical portions 23*a* and 23*b*, leakage currents from the cermet surface can be prevented. To obtain current supply wires 4*a* and 4*b* with sufficient strength, it is preferable to use a metal other than cermet.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A metal vapor discharge lamp comprising:

a discharge tube comprising a container made of ceramic, said container having a first cylindrical portion;

second cylindrical portions with an outer diameter that is smaller than an inner diameter of said first cylindrical portion;

third cylindrical portions with an outer diameter that is substantially the same as an inner diameter of said second cylindrical portion, tapered portions having an inner surface;

and containing a discharge metal compound sealed into said container; and a pair of electrodes having first ends and second ends arranged in said container;

wherein said first cylindrical portion, said tapered portions and said second cylindrical portions are formed in one piece;

each of said third cylindrical portions is attached to one of said second cylindrical portions;

the first ends of said pair of electrodes oppose each other inside the container;

the second ends of said pair of electrodes are attached and sealed into the third cylindrical portions using a sealing member;

an inner wall of said third cylindrical portions and said electrodes define a gap; and the inner surface of said tapered portions and a central axis of said electrodes define an angle of 40°–80°.

2. The metal vapor discharge lamp according to claim 1, satisfying $$0.85\ d \leqq D \leqq 0.95\ d$$

wherein d (mm) is an inner diameter of said third cylindrical portions and D (mm) is an outer diameter of at least a portion of said electrodes.

3. The metal vapor discharge lamp according to claim 1, wherein an axial length L (mm) of the gap defined by the inner wall of said third cylindrical portions and said electrodes is $$3\ \text{mm} \leqq L \leqq 10\ \text{mm}.$$

4. The metal vapor discharge lamp according to claim 1, wherein said second cylindrical portions overlap said third cylindrical portions in an axial direction over a length F (mm) of $1.5\ \text{mm} \leqq F \leqq 4.5\ \text{mm}$.

5. The metal vapor discharge lamp according to claim 1, satisfying $$0.5\ g \leqq E \leqq 3\ g$$

wherein E (mm) is a wall thickness of said second cylindrical portion, and g (mm) is a wall thickness of said third cylindrical portion.

6. The metal vapor discharge lamp according to claim 1, satisfying $$A/C \geqq 0.8$$

wherein C is a length of said first cylindrical portion, and A is an inner diameter of said first cylindrical portion.

7. The metal vapor discharge lamp according to claim 1, wherein said electrodes have a coil at least at a portion of an electrode portion located inside said third cylindrical portions.

8. The metal vapor discharge lamp according to claim 7, wherein said coil comprises molybdenum.

9. The metal vapor discharge lamp according to claim 1, wherein said electrodes comprise a feed portion located inside said third cylindrical portions; and an electrode rod, having a first and a second end, whose diameter is equal to or smaller than the diameter of said feed portion;

wherein the first end of said electrode rod is connected to said feed portion; and the second end of said electrode rod is located in said container.

10. The metal vapor discharge lamp according to claim 9, wherein said feed portion comprises tungsten.

11. The metal vapor discharge lamp according to claim 9, satisfying $$0.4\ L \leqq L_S \leqq 1.0\ L$$

wherein $L_S$ (mm) is an axial length of a gap defined by an inner wall of said third cylindrical portions and said feed portion, and L (mm) is an axial length of a gap defined by the inner wall of said third cylindrical portion and said electrodes.

12. The metal vapor discharge lamp according to claim 1, satisfying $$0.8 \leqq E/B \leqq 4.0$$

wherein B (mm) is a wall-thickness of said first cylindrical portion, and E (mm) is a wall-thickness of said second cylindrical portion.

13. The metal vapor discharge lamp according to claim 1, satisfying $$0.1 \leqq F/H \leqq 0.3$$

wherein F (mm) is an axial length of said second cylindrical portion, and H (mm) is an axial length of said third cylindrical portion.

14. The metal vapor discharge lamp according to claim 1, wherein said sealing member comprises a cermet.

15. The metal vapor discharge lamp according to claim 14, wherein said sealing member is enclosed by said third cylindrical portion.

16. The metal vapor discharge lamp according to claim 14, wherein said cermet comprises aluminum oxide and molybdenum.

17. The metal vapor discharge lamp according to claim 1, wherein said second cylindrical portion and said third cylindrical portion are connected by shrinkage fitting.

18. The metal vapor discharge lamp according to claim 1, wherein a correlated color temperature difference between vertical operation and horizontal operation is not more than 300 K.

* * * * *